United States Patent [19]

Etzbach et al.

[11] Patent Number: 5,037,798

[45] Date of Patent: Aug. 6, 1991

[54] TRANSFER OF AZO DYES

[75] Inventors: Karl-Heinz Etzbach, Frankenthal; Gunther Lamm, Hassloch; Helmut Reichelt, Neustadt; Ruediger Sens, Mannheim, all of Fed. Rep. of Germany

[73] Assignee: BASF Aktiengesellschaft, Ludwigshafen, Fed. Rep. of Germany

[21] Appl. No.: 358,142

[22] Filed: May 30, 1989

[30] Foreign Application Priority Data

May 31, 1988 [DE] Fed. Rep. of Germany ... P3818404.4

[51] Int. Cl.[5] ..... B41M 5/35; B41M 5/26

[52] U.S. Cl. ..... 503/227; 8/471; 428/195; 428/211; 428/913; 428/914

[58] Field of Search ..... 8/471; 428/195, 913, 428/914, 211; 503/227

[56] References Cited

U.S. PATENT DOCUMENTS

| | | | |
|---|---|---|---|
| 4,668,775 | 5/1987 | Bergmann et al. | 534/765 |
| 4,859,651 | 8/1989 | Gregory et al. | 503/227 |

FOREIGN PATENT DOCUMENTS

| | | | |
|---|---|---|---|
| 111004 | 6/1984 | European Pat. Off. | 503/227 |
| 201896 | 11/1986 | European Pat. Off. | 503/227 |
| 258856 | 3/1988 | European Pat. Off. | 503/227 |
| 127392 | of 1986 | Japan | 503/227 |
| 237694 | of 1986 | Japan | 503/227 |
| 283595 | of 1986 | Japan | 503/227 |

OTHER PUBLICATIONS

Patent Abstracts of Japan, vol. 9, No. 71 (C-272) [1794], (1985), 59-204658, Gousei Senriyou Gijutsu Kenkiyuu Kumiai.

Patent Abstracts of Japan, vol. 10, No. 109 (M-472) [2166], (1986), 60-239292, Mitsubishi Kasei Kogyo K.K.

*Primary Examiner*—Bruce H. Hess

*Attorney, Agent, or Firm*—Oblon, Spivak, McClelland, Maier & Neustadt

[57] ABSTRACT

Azo dyes are transferred from a substrate to a plastic-coated paper by diffusion with the aid of a thermal printing head, these azo dyes having the formula where $R^1$ and $R^2$ are each independently of the other hydrogen, substituted or unsubstituted alkyl or substituted or unsubstituted phenyl, $R^3$ is hydrogen, alkyl, alkoxy or substituted or unsubstituted alkanoyl- or benzoyl-amino, $R^4$ is hydrogen, chlorine, alkyl, alkoxy, alkylthio or substituted or unsubstituted phenyl and $R^5$ is cyano, substituted or unsubstituted alkoxy- or phenoxy-carbonyl or substituted or unsubstituted mono- or di-alkyl- or -phenyl-carbamoyl.

3 Claims, No Drawings

TRANSFER OF AZO DYES

The present invention relates to a novel process for transferring azo dyes having a thiophene-based diazo component from a substrate to a plastic-coated paper with the aid of a thermal printing head.

In thermotransfer printing processes, a transfer sheet which contains a thermally transferable dye in one or more binders with or without suitable assistants on a substrate is heated from the back with a thermal printing head in short heat pulses (duration: fractions of a second), as a result of which the dye migrates out of the transfer sheet and diffuses into the surface coating of a receiving medium. The essential advantage of this process is that control of the amount of dye to be transferred (and hence of the color gradation) is easily possible by adjusting the energy to be supplied to the thermal printing head.

In general, color recording is carried out using the three subtractive primaries yellow, magenta and cyan (and in certain cases black). To facilitate optimal color recording, the dyes must have the following properties:

i) ready thermal transferability,
ii) low migration tendency within or on the surface coating of the receiving medium at room temperature,
iii) high thermal and photochemical stability and resistance to moisture and chemical substances,
iv) suitable hues for subtractive color mixing,
v) a high molar adsorption coefficient,
vi) resistance to crystallization in the course of storage of the transfer sheet and
vii) ready industrial accessibility.

Requirements i), iii), vii) and in particular iv) and v) are from experience particularly difficult to meet in the case of cyan dyes.

For this reason most of the known cyan dyes used for thermal transfer printing do not meet the required range of properties.

There is prior art concerning dyes used in thermotransfer printing processes. For instance, EP-A-216,483 and EP-A-258,856 describe azo dyes from thiophene-based diazo components and aniline-based coupling components.

Furthermore, EP-A-218,937 describes thiophene- and aniline-based disazo dyes for this purpose.

It is an object of the present invention to provide a process for the transfer of dyes where the dyes should ideally meet all the abovementioned requirements i) to vii).

We have found that this object is achieved in an advantageous manner by transferring azo dyes from a substrate to a plastic-coated paper by diffusion with the aid of a thermal printing head on using a substrate on which there are one or more azo dyes of the formula I

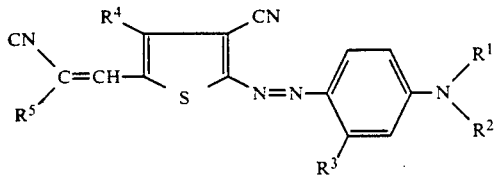

(I)

where $R^1$ and $R^2$ are identical or different and each is independently of the other alkyl, alkanoyloxyalkyl, alkoxycarbonyloxyalkyl or alkoxycarbonylalkyl, which each may have up to 20 carbon atoms and be substituted by phenyl, $C_1$–$C_4$-alkylphenyl, $C_1$–$C_4$-alkoxyphenyl, benzoyloxy, $C_1$–$C_4$-alkylbenzyloxy, $C_1$–$C_4$-alkoxybenzyloxy, halogen, hydroxyl or cyano, or are each hydrogen, unsubstituted or $C_1$–$C_{20}$-alkoxy- or halogen-substituted phenyl, unsubstituted or $C_1$–$C_{20}$-alkyl-, $C_1$–$C_{20}$-alkoxy- or halogen-substituted benzyl or a radical of the formula II $$[-Y-O]_m-R^6 \qquad \text{(II)}$$

where

Y is $C_2$–$C_6$-alkylene, m is 1, 2, 3, 4, 5 or 6 and $R^6$ is $C_1$–$C_4$-alkyl or unsubstituted or $C_1$–$C_4$-alkyl- or $C_1$–$C_4$-alkoxy-substituted phenyl, $R^3$ is hydrogen, $C_1$–$C_{10}$-alkyl, $C_1$–$C_{10}$-alkoxy or —NH—CO—$R^1$, where $R^1$ is as defined above, $R^4$ is hydrogen, chlorine, $C_1$–$C_4$-alkyl, $C_1$–$C_4$-alkoxy, $C_1$–$C_4$-alkylthio or unsubstituted or $C_1$–$C_4$-alkyl-, $C_1$–$C_4$-alkoxy- or halogen-substituted phenyl and $R^5$ is cyano or —CO—$OR^1$, —CO—$NHR^1$ or —CO—$NR^1R^2$, where $R^1$ and $R^2$ are each as defined above.

Any alkyl in the abovementioned formula I can be linear or branched.

Y in the formula I is for example ethylene, 1,2- or 1,3-propylene, 1,2-, 1,3- 1,4- or 2,3-butylene, pentamethylene, hexamethylene or 2-methylpentamethylene.

$R^1$, $R^2$, $R^3$, $R^4$ and $R^6$ in the formula I are each for example methyl, ethyl, propyl, isopropyl, butyl, isobutyl, sec-butyl or tert-butyl.

$R^1$, $R^2$ and $R^3$ are each further for example pentyl, isopentyl, neopentyl, tert-pentyl, hexyl, 2-methylpentyl, heptyl, octyl, 2-ethylhexyl, isooctyl, nonyl, isononyl, decyl or isodecyl.

$R^1$ and $R^2$ are each further for example undecyl, dodecyl, tridecyl, isotridecyl, tetradecyl, pentadecyl, hexadecyl, heptadecyl, octadecyl, nonadecyl or eicosyl. (The terms isooctyl, isononyl, isodecyl and isotridecyl are trivial names due to alcohols obtained by the oxo process (cf. Ullmanns Enzyklopädie der technischen Chemie, 4th edition, volume 7, pages 215–217 and volume 11, pages 435 and 436).)

$R^3$ and $R^4$ are each further for example methoxy, ethoxy, propoxy, isopropoxy, butoxy, isobutoxy or sec-butoxy.

$R^3$ is further for example pentyloxy, isopentyloxy, neopentyloxy, hexyloxy, heptyloxy, octyloxy, 2-ethylhexyloxy, nonyloxy or decyloxy.

$R^4$ is further for example methylthio, ethylthio, propylthio, isopropylthio or butylthio.

$R^1$ and $R^2$ are each further for example benzyl, 1- or 2-phenylethyl.

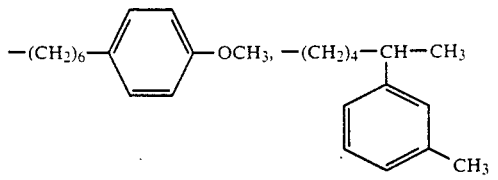

-continued
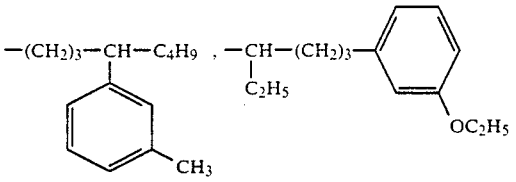
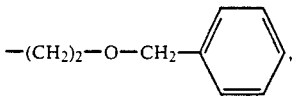
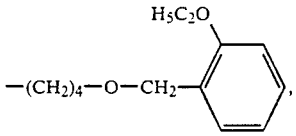
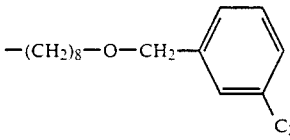
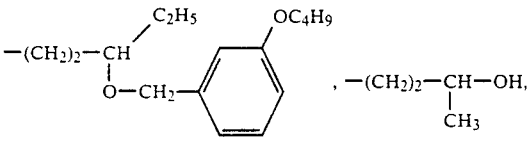
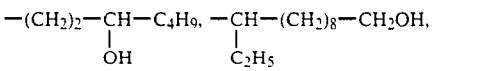
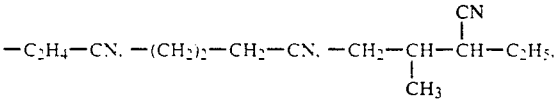
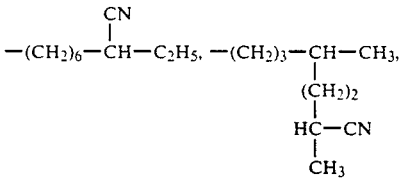
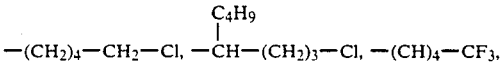
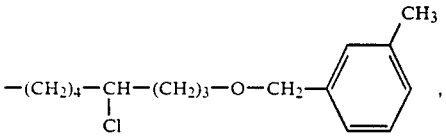
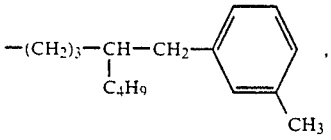
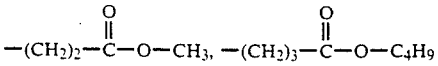
-continued
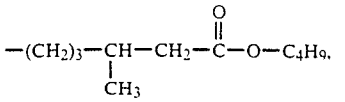
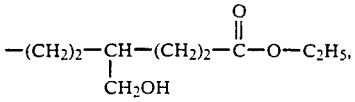
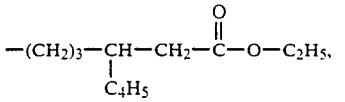
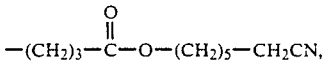
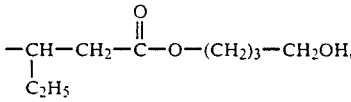
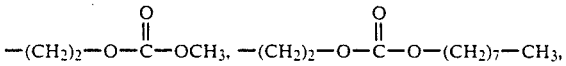
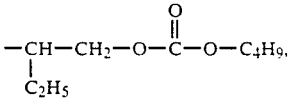
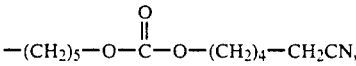
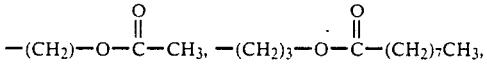
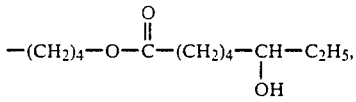
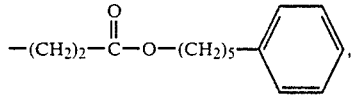
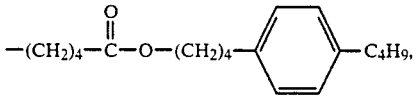
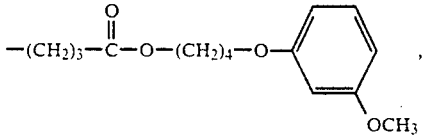
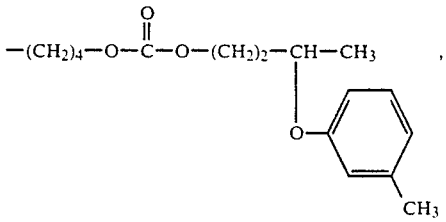

-continued

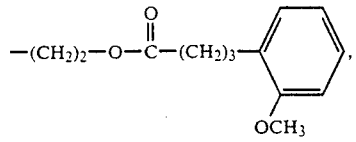

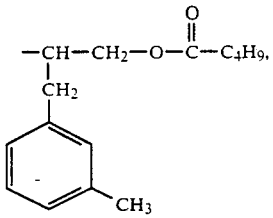

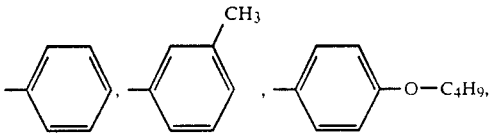

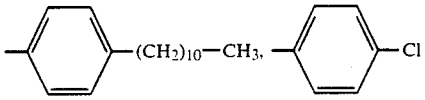

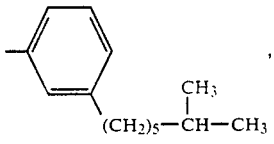

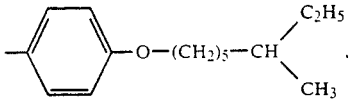

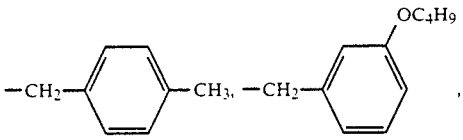

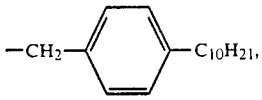

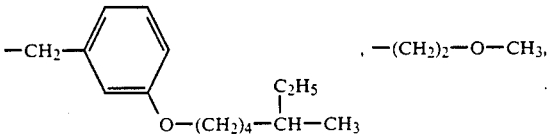

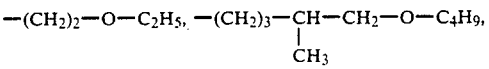

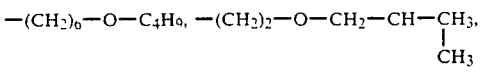

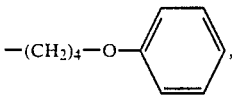

-continued

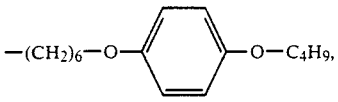

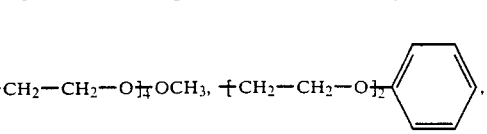

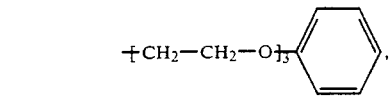

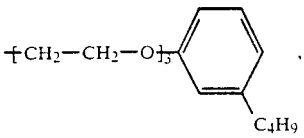

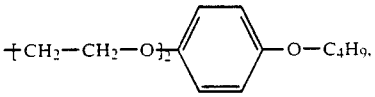

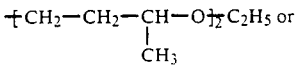

Preference is given to using in the process according to the invention a substrate on which there are one or more azo dyes of the formula I where $R^1$ and $R^2$ are each independently of the other alkyl, alkanoyloxyalkyl or alkyloxycarbonylalkyl, each of which may have up to 12 carbon atoms and be substituted by phenyl, $C_1$–$C_4$-alkylphenyl, $C_1$–$C_4$-alkoxyphenyl, hydroxyl or cyano, or are each independently of the other unsubstituted or $C_1$–$C_{12}$-alkyl- or $C_1$–$C_{12}$-alkoxy-substituted phenyl, unsubstituted or $C_1$–$C_{12}$-alkyl- or $C_1$–$C_{12}$-alkoxy-substituted benzyl or a radical of the formula II $$[-Y-O]_m-R^6 \qquad \text{(II)}$$

where

Y is $C_2$–$C_4$-alkylene, m is 1, 2, 3 or 4 and $R^6$ is $C_1$–$C_4$-alkyl or unsubstituted or $C_1$–$C_4$-alkyl- or $C_1$–$C_4$-alkoxy-substituted phenyl, $R^3$ is hydrogen, $C_1$–$C_6$-alkyl, $C_1$–$C_6$-alkoxy or —NH—CO—$R^1$, where $R^1$ is as defined most recently above, $R^4$ is hydrogen, chlorine, $C_1$–$C_4$-alkyl, $C_1$–$C_4$-alkoxy or phenyl and $R^5$ is cyano or —CO—$OR^1$, —CO—$NHR^1$ or —CO—$NR^1R^2$, where $R^1$ and $R^2$ are each as defined most recently above.

Use is made in the novel process in particular of a substrate on which there are one or more azo dyes of the formula I where $R^1$ and $R^2$ are each independently of the other $C_1$–$C_{12}$-alkyl which may be substituted by cyano, phenyl, $C_1$–$C_4$-alkylphenyl or $C_1$–$C_4$-alkoxyphenyl, or a radical of the formula III $$[-CH_2-CH_2-O]_n-R^7 \quad (III)$$

where
n is 1, 2, 3 or 4 and
$R^7$ is $C_1$–$C_4$-alkyl or phenyl,
$R^3$ is hydrogen, methyl, methoxy or acetylamino,
$R^4$ is chlorine and
$R^5$ is cyano or —CO—$OR^1$, —CO—$NHR^1$ or —CO—$NR^1R^2$, where $R^1$ and $R^2$ are each as defined most recently above.

Particularly good results are obtained on using a substrate on which there are one or more azo dyes of the formula I where $R^2$ is $C_1$–$C_6$-alkyl and $R^1$ is as defined most recently above or is in particular likewise $C_1$–$C_6$-alkyl.

Particularly favorable results are further obtained on using a substrate on which there are one or more azo dyes of the formula I where $R^5$ is cyano or —CO—$OR^1$, where $R^1$ is alkyl, alkanoyloxyalkyl or alkyloxycarbonylalkyl, each of which may have up to 12 carbon atoms, or the radical of the abovementioned formula III where n and $R^7$ are each as defined above, or $R^7$ is in particular $C_1$–$C_6$-alkyl.

The dyes of the formula I are known from EP-A201,896 or can be obtained by the methods mentioned therein.

Compared with the dyes used in existing processes, the dyes transferred in the process according to the invention are notable in general for improved migration properties in the receiving medium at room temperature, more ready thermal transferability, higher photochemical stability, easier industrial accessibility, better resistance to moisture and chemical substances, higher color strength, better solubility and in particular higher purity of hue.

It is further surprising that the dyes of the formula I are readily transferable despite their relatively high molecular weight.

To prepare the dye substrate required for the novel process, the dyes are incorporated in a suitable organic solvent, for example chlorobenzene, isobutanol, methyl ethyl ketone, methylene chloride, toluene, tetrahydrofuran or a mixture thereof, with one or more binders with or without assistants to give a printing ink. This ink preferably contains the dye in a molecularly dispersed, ie. dissolved, form. The printing ink is applied to the inert substrate by knife coating and dried in air.

Suitable binders are all resins or polymer materials which are soluble in organic solvents and are capable of holding the dye on the inert substrate in an abrasion-resistant bind. Preference is given to binders which, after the printing ink has dried in air, hold the dye in a clear, transparent film without visible crystallization of the dye.

Examples of such binders are cellulose derivatives, for example methylcellulose, ethylcellulose, ethylhydroxyethylcellulose, hydroxypropylcellulose, cellulose acetate or cellulose acetobutyrate, starch, alginates, alkyd resins, vinyl resins, polyvinyl alcohol, polyvinyl acetate, polyvinyl butyrate or polyvinylpyrrolidones. Other possibilities as binders are polymers and copolymers of acrylates or derivatives thereof, such as polyacrylic acid, polymethyl methacrylate or styrene/acrylate copolymers, polyester resins, polyamide resins, polyurethane resins or natural CH resins, such as gum arabic. Further suitable binders are described in DE-A-3,524,519.

Preferred binders are ethylcellulose and ethylhydroxyethylcellulose of medium to small viscosity.

The ratio of binder to dye preferably varies from 5:1 to 1:1.

Possible assistants are release agents as described in EP-A-227,092, EP-A-192,435 and the patent applications cited therein and also particularly organic additives which stop the transfer dye from crystallizing in the course of storage or heating of the inked ribbon, for example cholesterol or vanillin.

Inert substrates are for example tissue, blotting or parchment paper or plastics films of high heat stability, for example uncoated or metal-coated polyester, polyamide or polyimide. The inert substrate may additionally be coated on the side facing the thermal printing head with a lubricant, or slipping, layer in order to prevent adhesion of the thermal printing head to the substrate material. Suitable lubricants are described for example in EP-A-216,483 and EP-A-277,095. The thickness of the dye substrate is in general from 3 to 30 μm, preferably from 5 to 10 μm.

Suitable dye receiver layers are basically all temperature stable plastics layers having an affinity for the dyes to be transferred. Their glass transition temperature should be below 150° C. Examples are modified polycarbonates or polyesters. Suitable recipes for the receiver layer composition are described in detail for example in EP-A-227,094, EP-A-133,012, EP-A-133,011, EP-A-111,004, JP-A-199,997/1986, JP-A-283,595/1986, JP-A-237,694/1986 and JP-A-127,392/1986.

Transfer is effected by means of a thermal printing head which must be heatable to a temperature ≧300° C. for the dye transfer to take place within the time interval t: $0<t<15$ msec. On heating, the dye migrates out of the transfer sheet and diffuses into the surface coating of the receiving medium.

Details of the preparation may be found in the Examples, where percentages are by weight, unless otherwise stated.

Transfer of dyes

To be able to test the transfer characteristics of the dyes in a quantitative and simple manner, the thermotransfer was carried out with large hotplates instead of a thermal printing head, with the transfer temperature being varied within the range 70° C.$<T<$120° C. and the transfer time being set at 2 minutes.

A) General recipe for coating the substrate with dye 1 g of binder was dissolved at from 40° to 50° C. in 8 ml of 8:2 v/v toluene/ethanol. A solution of 0.25 g of dye (and any assistant used) in 5 ml of tetrahydrofuran was added by stirring. The print paste thus obtained was smoothed down with an 80 μm knife on a sheet of polyester film (thickness: 6–10 μm) and dried with a hair dryer.

B) Testing of Thermal transferability

The dyes used were tested in the following manner:

The polyester sheet donor containing the dye under test on the coated front was placed face down on commercial Hitachi Color Video Print Paper (receiver) and pressed down. Donor/receiver were then wrapped in aluminum foil and heated between two hotplates at different temperatures T (within the temperature range 70° C.<T<120° C.). The amount of dye diffusing into the bright plastics layer of the receiver is proportional to the optical density (=absorbance A). The latter was determined photometrically. If the logarithm of the absorbance A of the colored receiver papers measured within the temperature range from 80° to 110° C. is plotted against the corresponding reciprocal absolute temperature, the result is a straight line whose slope gives the activation energy $\Delta E_T$ for the transfer experiment:

$$\Delta E_T = 2{,}3 \cdot R \cdot \frac{\Delta \log A}{\Delta\left[\frac{1}{T}\right]}$$

To complete the characterization, the plots additionally indicate the temperature T*[°C.]at which the absorbance A of the dyed receiver papers attains the value 2.

The dyes mentioned in the Tables below were processed according to A), and the resulting dye-coated substrates were tested in respect of their transfer characteristics by B). The Tables list in each case the thermotransfer parameters T* and $\Delta E_T$, the absorption maximum of the dyes $\lambda_{max}$ (measured in methylene chloride), the binders used and the assistants.

The abbreviations have the following meanings:

B=binder (EC=ethylcellulose, EHEC=ethylhydroxyethylcellulose, MIX=mixture of polyvinyl butyrate and ethylcellulose in a weight ratio of 2:1)

D=dye

AUX=auxiliary (chol=cholesterol)

TABLE 1

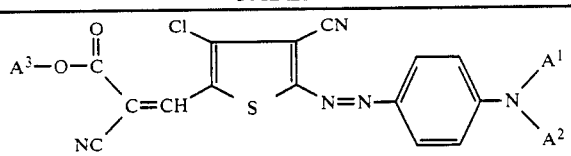

| Example No. | $A^1$ | $A^2$ | $A^3$ | $\lambda_{max}$ [nm] | B | AUX | T* [°C.] | $\Delta E_T$ [kcal/mol] |
|---|---|---|---|---|---|---|---|---|
| 1 | $C_4H_9$ | $C_4H_9$ | $C_2H_5$ | 645 | EC | — | 114 | 13 |
| 2 | $C_4H_9$ | $C_4H_9$ | $C_2H_5$ | 645 | EC | 0.19 g of chol | 101 | 18 |
| 3 | $C_4H_9$ | $C_4H_9$ | $C_4H_9$ | 648 | EC | — | 113 | 12 |
| 4 | $C_4H_9$ | $C_4H_9$ | $C_2H_4-O-C_2H_4-OCH_3$ | 650 | EC | — | 116 | 14 |
| 5 | $C_4H_9$ | $C_4H_9$ | $C_2H_4-O-C_2H_4-O-C_4H_9$ | 650 | EHEC | — | 100 | 16 |
| 6 | $CH_3$ | $C_3H_7$ | $C(CH_3)_3$ | 633 | EC | 0.38 g of chol | 102 | 27 |
| 7 | $CH_3$ | $CH(CH_3)_2$ | $C_4H_9$ | 640 | EC | — | 102 | 24 |
| 8 | $CH_3$ | $C_3H_7$ | $C_4H_9$ | 643 | EC | — | 106 | 21 |
| 9 | $C_4H_9$ | $C_6H_{13}$ | $CH_3$ | 649 | EC | — | 109 | 18 |
| 10 | $C_4H_9$ | $C_6H_{13}$ | $C(CH_3)_3$ | 641 | EC | — | 111 | 20 |
| 11 | $C_4H_9$ | $C_6H_{13}$ | $C_2H_5$ | 648 | EC | — | 115 | 18 |
| 12 | $C_4H_9$ | $C_6H_{13}$ | $C_4H_9$ | 650 | EC | — | 114 | 15 |
| 13 | $C_2H_5$ | $CH_2-CH(C_2H_5)(C_4H_9)$ | $C_4H_9$ | 644 | EC | — | 112 | 19 |
| 14 | $C_2H_5$ | $CH_2-CH(C_2H_5)(C_4H_9)$ | $C_4H_9$ | 644 | EHEC | — | 105 | 15 |
| 15 | $C_2H_5$ | $C_8H_{17}$ | $C_2H_5$ | 648 | EC | — | 113 | 23 |
| 16 | $C_2H_5$ | $C_8H_{17}$ | $C_4H_9$ | 645 | EC | — | 107 | 18 |
| 17 | $C_2H_5$ | $C_8H_{17}$ | $CH_3$ | 649 | EC | — | 106 | 20 |
| 18 | $C_2H_5$ | $C_6H_{13}$ | $C_4H_9$ | 646 | EC | — | 105 | 21 |
| 19 | $C_4H_9$ | $CH_2-CH(C_4H_9)(C_2H_5)$ | $C_2H_5$ | 650 | EC | — | 113 | 14 |
| 20 | $C_2H_5$ | $C_2H_4-O-C_4H_9$ | $C_2H_5$ | 637 | EC | — | 104 | 17 |
| 21 | $C_4H_9$ | $C_2H_4-O-C_4H_9$ | $C_2H_5$ | 640 | EC | — | 111 | 10 |
| 22 | $C_2H_5$ | $C_2H_4-O-C_2H_4-O-CH_3$ | $C_2H_5$ | 639 | EC | — | 107 | 16 |
| 23 | $C_2H_5$ | $C_2H_4-O-C_2H_4-O-C_4H_9$ | $C_2H_5$ | 636 | EC | — | 104 | 12 |
| 24 | $C_4H_9$ | $C_2H_4-O-C_2H_4-O-C_4H_9$ | $C_2H_5$ | 639 | EC | — | 106 | 11 |
| 25 | $C_4H_9$ | $C_4H_9$ | $CH_3$ | 645 | EC | — | 112 | 12 |
| 26 | $C_4H_9-O-C_2H_4$ | $C_4H_9-O-C_2H_4$ | $C_4H_9$ | 626 | EC | — | 106 | 13 |
| 27 | $C_4H_9-O-C_2H_4$ | $C_4H_9-O-C_2H_4$ | $CH_3-O-C_2H_4-O-C_2H_4$ | 636 | EC | — | 109 | 9 |
| 28 | $C_4H_9$ | $C_4H_9$ | $C_6H_5-O-C_2H_4$ | 652 | EC | — | 130 | 13 |
| 29 | $C_4H_9$ | $C_4H_9$ | $C_4H_9-O-C_2H_4$ | 647 | EC | — | 109 | 19 |

TABLE 1-continued

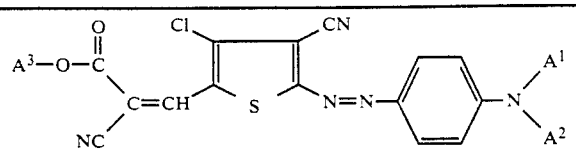

| Example No. | $A^1$ | $A^2$ | $A^3$ | $\lambda_{max}$ [nm] | B | AUX | T* [°C.] | $\Delta E_T \left[\frac{kcal}{mol}\right]$ |
|---|---|---|---|---|---|---|---|---|
| 30 | $C_4H_9$ | $C_4H_9$ | $C_6H_5-O-C_2H_4-O-C_2H_4$ | 649 | EC | — | 118 | 17 |
| 31 | $C_4H_9$ | $CH(CH_3)_2$ | $C_4H_9$ | 647 | MIX | — | 100 | 12 |
| 32 | $C_3H_7$ | $CH(CH_3)_2$ | $C_4H_9$ | 647 | MIX | — | 102 | 13 |
| 33 | $C_2H_5$ | $CH_3-(CH_2)_5$ | $C_4H_9-O-C_2H_4-O-C_2H_4$ | 648 | EC | — | 111 | 22 |
| 34 | $C_2H_5$ | $CH_3-(CH_2)_5$ | $CH_3-O-C_2H_4-O-C_2H_4$ | 649 | EC | — | 118 | 21 |
| 35 | $C_2H_5$ | $CH_3-(CH_2)_7$ | $C_6H_5-O-C_2H_4$ | 649 | EC | — | 124 | 15 |
| 36 | $C_2H_5$ | $CH_3-(CH_2)_7$ | $C_6H_5-O-C_2H_4-O-C_2H_4$ | 649 | EC | — | 121 | 15 |
| 37 | $C_2H_5$ | $CH_3-(CH_2)_7$ | $C_4H_9-O-C_2H_4-O-C_2H_4$ | 648 | EC | — | 113 | 18 |
| 38 | $C_2H_5$ | $CH_3-(CH_2)_7$ | $C_4H_9-O-C_2H_4$ | 639 | EC | — | 110 | 14 |
| 39 | $C_4H_9$ | $C_2H_5-CH(C_4H_9)-CH_2$ | $C_2H_5$ | 649 | EC | — | 113 | 21 |
| 40 | $C_4H_9$ | $C_6H_5-O-C_2H_4$ | $C_4H_9$ | 631 | EC | — | 133 | 16 |

TABLE 2

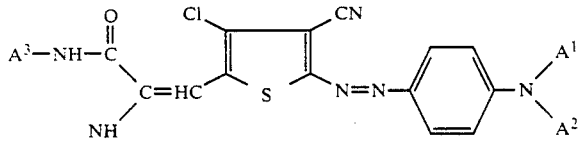

| Example No. | $A^1$ | $A^2$ | $A^3$ | $\lambda_{max}$[nm] | B | AUX | T*[°C.] | $\Delta E_T \left[\frac{kcal}{mol}\right]$ |
|---|---|---|---|---|---|---|---|---|
| 41 | $C_4H_9$ | $C_4H_9$ | $CH_3-(CH_2)_6$ | 635 | EC | — | 115 | 10 |
| 42 | $C_4H_9$ | $CH_3(CH_2)_5$ | $CH_3-(CH_2)_6$ | 637 | EC | — | 126 | 17 |
| 43 | $C_4H_9$ | $CH_3(CH_2)_5$ | $C_4H_9-O-C_2H_4-O-C_2H_4$ | 649 | EC | — | 111 | 11 |
| 44 | $C_4H_9$ | $C_4H_9$ | $C_4H_9-O-C_2H_4-O-C_2H_4$ | 649 | EC | — | 121 | 11 |

TABLE 3

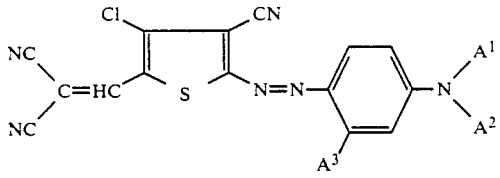

| Example No. | $A^1$ | $A^2$ | $A^3$ | $\lambda_{max}$[nm] | B | AUX | T*[°C.] | $\Delta E_T \left[\frac{kcal}{mol}\right]$ |
|---|---|---|---|---|---|---|---|---|
| 45 | $C_4H_9$ | $C_4H_9$ | H | 672 | EC | 0.19 g of chol | 100 | 18 |
| 46 | $C_4H_9$ | $CH_2-CH(C_4H_9)-C_2H_5$ | H | 674 | EC | — | 105 | 20 |
| 47 | $C_2H_5$ | $C_4H_9-CH(C_2H_5)-CH_2-O-C(=O)-C_2H_4$ | H | 651 | EC | — | 110 | 12 |
| 48 | $C_4H_9$ | $C_4H_9$ | $CH_3$ | 683 | MIX | — | 107 | 14 |

TABLE 4

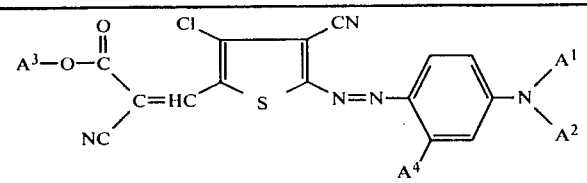

| Example No. | $A^1$ | $A^2$ | $A^3$ | $A^4$ | $\lambda_{max}$[nm] | B | AUX | T*[°C.] | $\Delta E_T \left[\frac{kcal}{mol}\right]$ |
|---|---|---|---|---|---|---|---|---|---|
| 49 | $C_4H_9$ | $C_4H_9$ | $C_4H_9$ | $C_3H_7$—CO—NH | 649 | EC | — | 126 | 22 |
| 50 | $C_2H_5$ | $C_2H_5$ | $C_4H_9$—O—$C_2H_4$—O—$C_2H_4$ | $C_4H_9$—NH—CO—NH | 645 | EC | — | 120 | 14 |
| 51 | $C_4H_9$ | $C_4H_9$ | $C_4H_9$—O—$C_2H_4$—O—$C_2H_4$ | $C_2H_5$—CO—NH | 650 | EC | — | 129 | 10 |
| 52 | $C_2H_5$ | $C_2H_5$ | $C_4H_9$—O—$C_2H_4$—O—$C_2H_4$ | 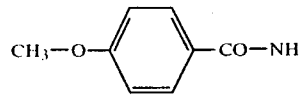 | 667 | EC | — | 140 | 13 |
| 53 | $C_4H_9$ | $CH_3$—$COOC_2H_4$ | $C_4H_9$—O—$C_2H_4$—O—$C_2H_4$ | $CH_3$—CO—NH | 667 | EC | — | 145 | 7 |
| 54 | $C_6H_5$—$CH_2$ | $C_2H_5$ | $C_4H_9$—O—$C_2H_4$—O—$C_2H_4$ | $CH_3$—CO—NH | 635 | EC | — | 128 | 12 |
| 55 | $C_2H_5$ | $CH_3$—$COOC_2H_4$ | $C_4H_9$ | $C_6H_5$—CO—NH | 647 | MIX | — | 119 | 18 |
| 56 | $C_4H_9$ | NC—$C_2H_4$ | $C_4H_9$ | $CH_3$—CO—NH | 619 | MIX | — | 122 | 19 |
| 57 | $C_4H_9$ | $CH_3$—$COOC_2H_4$ | $C_4H_9$ | $CH_3$—CO—NH | 631 | MIX | — | 111 | 16 |
| 58 | $C_6H_5$—$CH_2$ | $CH_3$—$COOCH_2$ | $C_4H_9$—O—$C_2H_4$—O—$C_2H_4$ | $CH_3$—CO—NH | 614 | MIX | — | 116 | 10 |
| 59 | $CH_3$—COO—$C_4H_8$ | $CH_3$—$COOC_4H_8$ | $C_4H_9$—O—$C_2H_4$—O—$C_2H_4$ | $CH_3$—CO—NH | 640 | EC | — | 115 | 14 |
| 60 | $C_2H_5$ | $H_3COOC$—$C_2H_4$ | $C_4H_9$—O—$C_2H_4$—O—$C_2H_4$ | $CH_3$—CO—NH | 632 | EC | — | 130 | 10 |
| 61 | $C_2H_5$ | $C_4H_9$—OOC—$C_2H_4$ | $C_4H_9$—O—$C_2H_4$—O—$C_2H_4$ | $CH_3$—CO—NH | 625 | EC | — | 131 | 9 |
| 62 | $CH_3$—COO—$C_2H_4$ | $CH_3$—COO—$C_2H_4$ | $C_4H_9$ | $CH_3$ | 617 | EC | — | 114 | 11 |
| 63 | $C_2H_5$ | $C_2H_5$—O—C(=O)—O—$C_2H_4$ | $C_4H_9$ | $CH_3$ | 631 | MIX | — | 106 | 13 |
| 64 | $C_4H_9$ | $C_4H_9$ | $C_4H_9$—O—$C_2H_4$—O—$C_2H_4$ | $CH_3$ | 661 | EC | — | 113 | 16 |
| 65 | $C_4H_9$ | $C_4H_9$ | $C_4H_9$—O—$C_2H_4$ | $CH_3$ | 658 | EC | — | 116 | 13 |
| 66 | $(CH_3)_2CH$ | HO—$C_2H_4$ | $C_4H_9$—O—$C_2H_4$—O—$C_2H_4$ | $CH_3$ | 636 | EC | — | 129 | 8 |
| 67 | $C_2H_5$ | Cl—$C_2H_4$ | $C_4H_9$—O—$C_2H_4$—O—$C_2H_4$ | $CH_3$ | 629 | EC | — | 124 | 12 |
| 68 | $C_4H_9$ | $C_4H_9$ | $C_4H_9$ | $CH_3$ | 659 | EC | — | 127 | 10 |
| 69 | $C_4H_9$ | $C_4H_9$ | $C_2H_5$ | $CH_3$ | 658 | MIX | — | 104 | 18 |
| 70 | $C_4H_9$ | $C_4H_9$ | $C_3H_7$ | $CH_3$ | 656 | MIX | — | 99 | 15 |
| 71 | $C_4H_9$ | $C_4H_9$ | $CH_3$ | $CH_3$ | 660 | MIX | — | 112 | 16 |
| 72 | $C_4H_9$ | $C_4H_9$ | $C_4H_9$—O—$C_2H_4$—O—$C_2H_4$ | $OCH_3$ | 656 | MIX | — | 116 | 12 |
| 73 | $C_4H_9$ | $C_4H_9$ | $C_4H_9$—O—$C_2H_4$ | $OCH_3$ | 656 | EC | — | 107 | 11 |
| 74 | $C_4H_9$ | $C_4H_9$ | $C_4H_9$—O—$C_2H_4$—O—$C_2H_4$ | $OCH_3$ | 655 | EC | — | 113 | 13 |
| 75 | $C_4H_9$ | $C_4H_9$ | $C_4H_9$ | $OCH_3$ | 655 | EC | — | 114 | 14 |
| 76 | $C_2H_5$ | $C_2H_5$ | $C_4H_9$ | O—$CH(CH_3)_2$ | 636 | MIX | — | 106 | 14 |
| 77 | $C_2H_5$ | $C_2H_5$ | $C_4H_9$ | O—$CH_2$—CH(OH)—$CH_3$ | 645 | MIX | — | 103 | 15 |

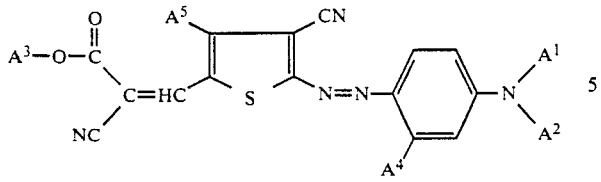

Y is $C_2$–$C_6$-alkylene, m is 1, 2, 3, 4, 5 or 6 and $R_6$ is $C_1$–$C_4$-alkyl or unsubstituted or $C_1$–$C_4$-alkyl- or $C_1$–$C_4$-alkoxy-substituted phenyl, or each is a radical of the formula II $R^3$ is hydrogen, $C_1$–$C_{10}$-alkyl, $C_1$–$C_{10}$-alkoxy or —NH—CO—$R^1$, where $R^1$ is as defined above, $R^4$ is hydrogen, chlorine, $C_1$–$C_4$-alkyl, $C_1$–$C_4$-alkoxy, $C_1$–$C_4$-alkylthio or unsubstituted or $C_1$–$C_4$-alkyl,

TABLE 5

| Example No. | $A^1$ | $A^2$ | $A^3$ | $A^4$ | $A^5$ |
|---|---|---|---|---|---|
| 78 | $C_3H_7$ | $C_3H_7$ | $C_4H_9$ | H | H |
| 79 | $C_4H_9$ | $C_6H_{13}$ | $C_2H_5$ | H | $CH_3$ |
| 80 | $C_4H_9$ | $C_4H_9$ | $CH_3$ | $CH_3$—CO—NH | $CH_2H_5$—O |
| 81 | $C_4H_9$—O—$C_2H_4$ | $C_4H_9$ | $C_4H_9$ | $CH_3$ | $CH_3$ |
| 82 | $C_4H_9$ | $CH_3$—O—$C_2H_4$ | $C_3H_7$ | $CH_3$—O | $C_6H_5$ |
| 83 | $C_4H_9$—O—$C_2H_4$—O—$C_2H_4$ | $C_2H_5$ | $C_4H_9$ | H | 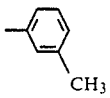 |
| 84 | $C_4H_9$—CH(—$C_2H_5$)—$CH_2$ | $C_4H_9$ | $CH_3$ | $CH_3$ | $CH_3$ |
| 85 | $C_2H_5$ | $C_6H_5$—O—$C_2H_4$—O—$C_2H_4$ | $C_4H_9$ | $CH_3$—CONH | $CH_3$ |
| 86 | $C_3H_7$ | $C_4H_9$ | $C_4H_9$—O—$C_2H_4$ | $C_2H_5$ | $CH_3$ |
| 87 | $C_4H_9$ | $C_4H_9$ | $C_4H_9$—O—$C_2H_4$—O—$C_2H_4$ | $CH_3$ | $C_2H_5$ |
| 88 | $C_4H_9$ | $C_2H_5$ | $C_6H_5$—O—$C_2H_4$—O—$C_3H_6$ | $C_2H_5$ | $C_2H_5$—O |
| 89 | $C_{10}H_{21}$ | $C_2H_5$ | $CH_3$ | $CH_3$—CO—NH | H |

We claim:

1. A process for transferring azo dyes from a substrate to a plastic-coated paper by diffusion with the aid of a thermal printing head, which comprises using a substrate on which there are one or more azo dyes of the formula I

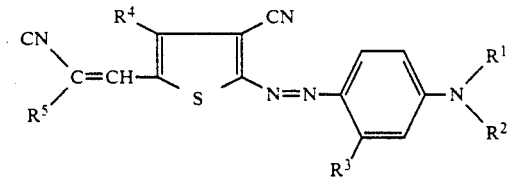

(I)

where $R^1$ and $R^2$ are identical or different and each is, independently of the other: alkyl, alkanoyloxyalkyl, alkoxycarbonyloxyalkyl or alkoxycarbonylalkyl, each group having 1 to 20 carbon atoms or $R^1$ and $R^2$ are independently, one of the above-mentioned groups either unsubstituted or substituted by phenyl, $C_1$–$C_4$-alkylphenyl, $C_1$–$C_4$-alkoxyphenyl, benzyloxy, $C_1$–$C_4$-alkylbenzyloxy, $C_1$–$C_4$-alkoxybenzyloxy, halogen, hydroxyl or cyano, or are each independently of the other hydrogen, unsubstituted or $C_1$–$C_{20}$-alkyl-, $C_1$–$C_{20}$-alkoxy- or halogen-substituted phenyl, unsubstituted or $C_1$–$C_{20}$-alkyl-, $C_1$–$C_{20}$-alkoxy- or halogen-substituted benzyl, unsubstituted or $C_1$–$C_{20}$-alkyl-, $C_1$–$C_{20}$-alkoxy- or halogen-substituted benzyl or formula II $$[-Y-O]_m-R^6$$

where $C_1$–$C_4$-alkoxy- or halogen-substituted phenyl and $R^5$ is cyano or —CO—$R^1$, —CO—NH$R^1$ or —CO—N$R^1R^2$, where $R^1$ and $R^2$ are each as defined above provided that when $R^5$ is CN one of $R^1$ and $R^2$ is the radical of formula II.

2. A process as claimed in claim 1, wherein on the substrate used there are one or more azo dyes of the formula I where $R^1$ $R^2$ are each independently of the other alkyl, alkanoyloxyalkyl or alkyloxycarbonylalkyl, each group having 1 to 20 carbon atoms or are the above-mentioned groups substituted by phenyl, $C_1$–$C_4$-alkylphenyl, $C_1$–$C_4$-alkoxyphenyl, hydroxyl or cyano, or are each independently of the other unsubstituted or $C_1$–$C_{12}$-alkyl-, $C_1$–$C_{12}$-alkoxy-substituted phenyl, unsubstituted or $C_1$–$C_{12}$-alkyl-, $C_1$–$C_{12}$-alkoxy-substituted benzyl or a radical of the formula II $$[-Y-O]_m-R^6 \qquad \text{(II)}$$

where

Y is $C_2$–$C_4$-alkylene, m is 1, 2, 3, or 4 and $R^6$ is $C_1$–$C_4$-alkyl or unsubstituted or $C_1$–$C_4$-alkyl- or $C_1$–$C_4$-alkoxy-substituted phenyl, $R^3$ is hydrogen, $C_1$–$C_6$alkyl, $C_1$–$C_6$-alkoxy or —NH—CO—$R^1$, where $R^1$ is as defined above, $R^4$ is hydrogen, chlorine, $C_1$–$C_4$-alkyl, $C_1$–$C_4$-alkoxy, or phenyl and $R^5$ is cyano or —CO—$R^1$, —CO—NH$R^1$ or —CO—N$R^1R^2$, where $R^1$ and $R^2$ are each as defined above.

3. A process as claimed in claim 1, wherein on the substrate used there are one or more azo dyes of the formula I where $R^1$ and $R^2$ are each independently of the other $C_1$-$C_{12}$-alkyl or $C_1$-$C_{12}$-alkyl substituted by cyano, phenyl, $C_1$-$C_4$-alkylphenyl or $C_1$-$C_4$-alkoxyphenyl, or a radical of the formula III $$[-CH_2-CH_2-O]_n-R^7 \quad \text{(III)}$$

where n is 1, 2, 3, or 4 and $R^7$ is $C_1$-$C_4$-alkyl or phenyl, $R^3$ is hydrogen, methyl, methoxy or acetylamino, $R^4$ is chlorine and $R^5$ is cyano or $-CO-R^1$, $-CO-NHR^1$ or $-CO-NR^1R^2$, where $R^1$ and $R^2$ are each as defined above.

* * * * *